United States Patent [19]

Leonard

[11] 4,441,947

[45] Apr. 10, 1984

[54] ARTICULATED FABRIC FORMED BY SELF-ASSEMBLING FIBERS

[75] Inventor: Edward F. Leonard, Bronxville, N.Y.

[73] Assignee: The Procter & Gamble Company, Cincinnati, Ohio

[21] Appl. No.: 533,172

[22] Filed: Sep. 19, 1983

Related U.S. Application Data

[62] Division of Ser. No. 367,203, Apr. 12, 1982, Pat. No. 4,421,818.

[51] Int. Cl.[3] ..... B32B 31/00; D04H 3/16

[52] U.S. Cl. ..... 156/158; 156/304.2; 156/309.6; 28/103; 28/112

[58] Field of Search ..... 28/103, 112; 156/158, 156/84, 304.2, 309.6; 428/221, 222, 288, 374, 32, 33, 127, 157, 332, 294

[56] References Cited

U.S. PATENT DOCUMENTS

| | | | |
|---|---|---|---|
| 3,026,569 | 3/1962 | Keller | 156/158 X |
| 3,235,935 | 2/1966 | Darvwalla | 28/112 |
| 3,416,991 | 12/1968 | Yoshimura | 156/84 X |
| 3,499,810 | 3/1970 | Wagle | 28/103 |
| 3,616,123 | 10/1971 | Reynolds et al. | 428/222 |
| 3,669,335 | 3/1975 | Siefert | 428/294 |
| 3,684,647 | 8/1972 | Matsui et al. | 428/374 X |
| 3,904,458 | 9/1975 | Wray | 156/85 |
| 3,917,448 | 11/1975 | Wood | 8/125 |
| 3,947,315 | 3/1976 | Smith | 28/103 |
| 3,969,170 | 7/1976 | Landgraf | 156/158 |
| 4,017,659 | 4/1977 | Bumlik | 428/397 |
| 4,172,172 | 10/1979 | Suzuki et al. | 428/224 |
| 4,172,174 | 10/1979 | Takagi | 428/288 |
| 4,181,450 | 1/1980 | Rasen et al. | 428/288 X |
| 4,188,690 | 2/1980 | Suzuki et al. | 28/103 |
| 4,207,135 | 6/1980 | Pavano | 156/158 X |
| 4,224,373 | 9/1980 | Mauzocchi | 428/288 |
| 4,390,384 | 6/1983 | Turner | 156/309.6 X |

FOREIGN PATENT DOCUMENTS

| | | | |
|---|---|---|---|
| 1115440 | 10/1961 | Fed. Rep. of Germany | 156/158 |
| 1927612 | 4/1971 | Fed. Rep. of Germany | 156/158 |
| 2426347 | 12/1974 | Fed. Rep. of Germany | 156/158 |
| 2127418 | 10/1972 | France | 428/371 |
| 55-93813 | 7/1980 | Japan . | |
| 55-93812 | 7/1980 | Japan . | |
| 996688 | 6/1965 | United Kingdom | 156/158 |

*Primary Examiner*—George F. Lesmes
*Assistant Examiner*—Nancy A. B. Swisher
*Attorney, Agent, or Firm*—E. Kelly Linman; John V. Gorman; Richard C. Witte

[57] ABSTRACT

A patterned, nonwoven, articulated fabric exhibiting a substantially uniform texture and comprised of a multiplicity of synthetic fiber elements, the opposing free ends of each of said synthetic fiber elements being joined to one another to form substantially continuous loops, said loops being interconnected to one another in a predetermined pattern. Method for producing said nonwoven fabric using specially prepared fiber elements which curl in a predetermined configuration in response to an external stimulus is also disclosed.

11 Claims, 6 Drawing Figures

ARTICULATED FABRIC FORMED BY SELF-ASSEMBLING FIBERS

This is a division, of application Ser. No. 367,203, filed Apr. 12, 1982, now U.S. Pat No. 4,421,818.

TECHNICAL FIELD

The present invention relates to a patterned, nonwoven, articulated fabric comprised of interlocking synthetic fiber elements and to a process for making said fabric utilizing self-assembling fibers. The basic method comprises the steps of: (a) preparing fiber elements that will pass irreversibly from a substantially straight configuration to a substantially closed ring upon appropriate stimulation, e.g., heating; (b) continuously juxtaposing said fiber elements in a predetermined configuration prior to curling; (c) subjecting said fiber elements to external stimulation to make them curl and interlock with one another in a predetermined pattern; and (d) completing the closure of said substantially continuous interlocked loops by joining the ends thereof to form a permanent structure. The resultant chain-mail type fabric exhibits extremely favorable drape and conformability characteristics.

BACKGROUND ART

Prior art fabrics exhibiting desirable drape and conformability characteristics are most typically produced by weaving or knitting processes. However, the labor of weaving or knitting such prior art fabrics is immense. According to *Man-Made Fibers* by R. W. Moncrieff, John Wiley & Sons, New York, 1975, there will be about six or seven million yarn intersections in a square yard of an ordinary woven jappe. While the loom makes these fairly efficiently, their number sets a limit to the speed with which fabric can be produced. Somewhat similar considerations apply to knitting. There has, therefore, been a considerable incentive to make fabric by methods which avoided the onerous processes of weaving and knitting fabrics either: (a) from film; (b) from felts; (c) from fibers which are bonded or stuck together with some drysetting adhesive to form a felt-like sheet; or by (d) the preparation of similar felt-like sheets on a rubber or plastic backing, usually for carpets; (e) welding of fibers which soften when heated so that one fiber welds to another; (f) bonding with a latent solvent for the fibers; etc.

While prior art nonwoven fabrics are cheaper and less time consuming to produce than the aforementioned knitted and woven fabrics, they generally do not possess the qualities of a woven fabric. Such qualities as drape, hand, and sometimes strength are lacking, since bonding between fibers restricts freedom of motion.

Accordingly, it is an object of the present invention to produce a nonwoven fabric from synthetic monofilament fibers in the form of a regulated chain-mail type structure.

It is a further object of the present invention to prepare a synthetic monofilament fiber that will pass irreversibly from the configuration of a straight rod to that of a substantially closed ring, upon appropriate stimulation, e.g., a change in the surrounding temperature.

It is a further object of the present invention to provide method and apparatus for continuously juxtaposing said treated fiber segments prior to curling so that they will intertwine appropriately to form the aforesaid chain-mail type of structure upon external stimulation.

It is yet another object of the present invention to provide method and apparatus for completing the closure of the ringed, intertwined synthetic fiber segments, e.g., as by a chemical treatment localized at the cut ends of the fiber.

DISCLOSURE OF THE INVENTION

In a particularly preferred embodiment, the present invention relates to a patterned, nonwoven, articulated fabric comprised of interlocking synthetic fiber elements. A preferred method for producing said articulated fabric comprises the steps of: (a) preparing fiber elements that will pass irreversibly from a substantially straight configuration to that of a substantially closed ring upon appropriate stimulation, e.g., heating; (b) continuously juxtaposing said fiber elements in a predetermined orientation and configuration prior to curling; (c) subjecting said fiber elements to external stimulation to make them curl and interlock with one another in a predetermined pattern; and (d) completing the closure of said substantially continuous interlocked loops by securing the opposing free ends of each loop to one another to increase the strength of and impart permanence to the resultant structure.

In a particularly preferred embodiment of the present invention, assembly of the fiber elements into a chain-mail type network is carried out in a fluid medium. The resultant fabric structure exhibits a regulated pattern as well as high drape and conformability due to the controlled interlocking of the individual fiber elements. As utilized herein, the term "regulated" refers to the highly deterministic non-random quality of formed fabrics of the present invention and the accompanying degree of process control that achieves this end objective. In a particularly preferred embodiment of the present invention, the fiber elements are comprised of nylon monofilaments treated approximately half way through their cross-section with phenol to permit subsequent curling in a predetermined orientation upon the application of heat.

BRIEF DESCRIPTION OF THE DRAWINGS

While the specification concludes with claims particularly pointing out and distinctly claiming the present invention, it is believed the present invention will be better understood from the following description in which:

DETAILED DESCRIPTION OF THE INVENTION

Figure 1:
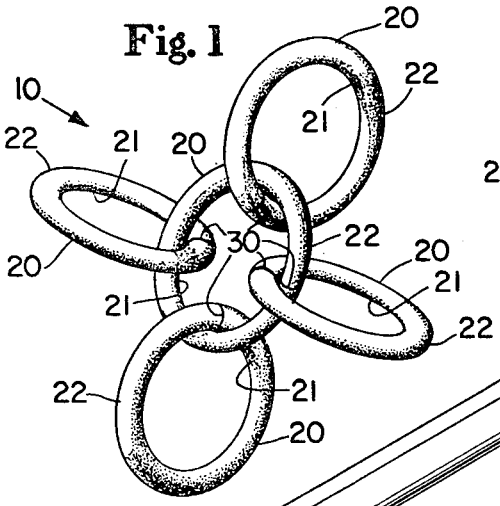
FIG. 1 is a simplified schematic illustration of a single filament which has been interlocked with four adjacent filaments.

FIG. 1 discloses a single unit pattern taken from a continuous sample of a particularly preferred interlocked chain-mail type fabric 10 of the present invention formed by means of a plurality of self-curling fibers 20 of the present invention. It is of course recognized that a two-dimensional fabric of the present invention can be created utilizing an even more basic unit pattern comprising a first fibrous loop formed by a first fibrous element interlocked with as few as three additional fibrous loops also formed by fibrous elements. It is further recognized that it is not necessary for every fibrous loop within such a fabric be similarly interlocked with three additional fribrous loops. Some such loops may interlock with as few as two additional fibrous loops to create a continuous two-dimensional structure of the aforementioned type.

For purposes of illustration, the single centrally located fibrous element 20 shown in FIG. 1 is interlocked with four peripherally located fibrous elements 20. While it is contemplated that the present invention would be practiced on a macroscopic scale by similarly interlocking said peripheral fibrous elements 20 with one or more similar fibrous elements 20 in whatever pattern is desired in the resultant structure, said additional linkages have not been shown in order to simplify the description of the present invention.

In the condition illustrated in FIG. 1, five discrete synthetic fiber elements 20 have been caused to curl in a predetermined orientation such that their opposing free ends have come into abutting contact with one another, and the opposing free ends of each element have thereafter been secured at joints 30 to form discrete circular links permanently interlocked, but otherwise unbonded to one another.

The basic steps involved in the preparation of a fabric such as that illustrated in FIG. 1 include: (1) preparation of fiber segments that will pass irreversibly from straight lengths to closed rings upon appropriate stimulation, e.g., a change in the temperature or composition of the surrounding medium; (2) continuously juxtaposing said fiber segments prior to curling such that when the fiber segments are subjected to external stimulation they will intertwine and interlock in predetermined fashion; and (3) completing the closure of the ringed, intertwined fiber segments, preferably by a thermal or chemical treatment that is effective only at the cut ends of the fibers. It is of course recognized that for complex patterns of interlocking fiber segments, the juxtaposing and curling steps may be carried out in more than a single stage to avoid collisions which might otherwise occur if all of the fibers utilized in the resultant fabric are caused to undergo simultaneous curling.

The crimping or tendency to curl inherent in natural fibers is a commonly observed phenomenon. Wool is one such naturally crimping fiber. The crimping of synthetic fibers is also known. For example, U.S. Pat. No. 4,172,172 issued to Suzuki et al. on Oct. 23, 1979 discloses a non-patterned, nonwoven fabric composed of synthetic fiber, preferably 100 percent polyester fiber, wherein individual fibers are held together by three-dimensional entanglement into a stabilized sheet form without being subjected to any bonding treatment. The described method for manufacturing a web of the type disclosed in the patent to Suzuki et al. comprises placing on a substantially smooth supporting member a web composed of highly shrinkable synthetic fiber having a potential heat shrinkage of 50% or more, exposing said web to the impact of fine jet streams of water discharged under a pressure of 10–35 kilograms per square centimeter, thereby allowing individual fibers to entangle with one another, thereafter subjecting the web to wet heat treatment at free length conditions to allow the web to shrink by 50% or more in area, drying the web at a temperature at which no change takes place in the shape and internal structure of the individual fibers, and then subjecting the web to heat setting under an applied pressure of 200 grams per square centimeter or more.

A nonwoven web 10 of the present invention differs from the web disclosed in the aforementioned patent to Suzuki et al. in that the resultant web is patterned rather than random. In addition, the opposing free ends of the circular links formed are bonded to one another to provide interlocked rings arranged in a predetermined pattern, but otherwise unadhered to one another.

In particular, the monofilament fibers 20 employed in the practice of the present invention are treated so as to curl in a predetermined orientation in response to an external stimulus. The treated fibers are thereafter placed in a high viscosity fluid medium from which curling is to take place in a regulated, deterministic fashion. Accordingly, nonwoven fabrics of the present invention can be made to exhibit the regulated aspects of woven and knitted fabrics, while being produced with the ease and facility of nonwoven webs. In addition, since the filaments are only interlocked, but not bonded to one another, nonwoven fabrics of the present invention exhibit drape, conformability and strength not achievable in prior art nonwoven webs.

In a particularly preferred embodiment of the present invention, the crimping exhibited by the fibers 20 is caused by temperature or solvent-induced relaxation of a monofilament fiber, the cross-section of which has previously been asymmetrically treated along its length. In a particularly preferred embodiment, an asymmetric phenol treatment of round nylon fibers to cause highly controllable, irreversible, planar curling, which occurs upon heating, is carried out. While not wishing to be bound by the theory of operation, it is believed that the overall mechanism of curling is very similar to that which occurs in a bicomponent metallic strip, such as that used in thermostats.

When the opposing free ends of each fiber are to be permanently joined to one another after the curl-inducing stimulus has been removed, it is important that the curl induced in each fiber be irreversible in nature. As utilized herein, the term "irreversible" shall mean that the curled fiber substantially retains its curled conformation upon removal of the curl-inducing stimulus rather than returning to a substantially straight configuration. However, in embodiments of the present invention wherein the opposing free ends of each fiber are permanently joined to one another either instantaneously upon contact or in the presence of the curl-inducing stimulus, irreversibility upon removal of the curl-inducing stimulus is non-critical. Clearly, once the opposing free ends of each fiber have been permanently joined to one another, the fiber can no longer return to a planar condition when the curl-inducing stimulus is removed, regardless of the irreversibility of the induced curl.

In an exemplary embodiment, the present fiber preparation process may be carried out utilizing 0.35 millimeter diameter monofilament fishing line substantially round in cross-section and comprised of highly oriented Nylon 6, such as is available from E. I. DuPont De Nemours & Company, Inc. of Wilmington, Delaware, under the specification "Stren", ten pound test. The monofilament fishing line is preferably subjected to the following steps: (1) reorient the monofilament to overcome its having been wound on a spool. This may be done by annealing the line under tension, preferably for a period of about 12 hours at a temperature of about 200° F.; (2) wash the monofilament line with heptane to remove the silicone oil typically added in the commercial process for making the line to prevent sticking of the wound fibers; (3) cut the line into predetermined lengths slightly greater than that desired in the finished fibers, e.g., a cut length of slightly in excess of one centimeter; (4) float the discrete cut fibers on a seven percent phenol solution for a period of approximately three seconds to allow for the asymmetric diffusion of phenol approximately half way through the monofilament's cross-section. A methylene blue dye is preferably incorporated in the phenol solution so that the treated portion of the fiber may later be distinguished from the untreated portion; (5) quench the treated fibers in a two percent sodium hydroxide solution; (6) wash the treated and quenched fibers with water; (7) coat the entire external surface of each treated fiber with varnish or any similar material which is substantially impermeable to solutions of phenol by completely immersing said fibers in said phenol-impermeable material to facilitate subsequent bonding of only the fiber ends to one another; (8) provide each of the treated and coated fibers with uncoated end surfaces by cutting off both ends of each fiber to produce individual treated and coated fiber elements of the desired length, e.g., a cut length of approximately one centimeter. It will be appreciated that although the cuts shown in the Drawing Figures are oriented substantially perpendicular to the longitudinal axis of the fiber, parallel cuts may be made at any desired angle to the fiber's axis to increase the available bonding area and to minimize alignment problems between the fiber's free ends after curling; (9) immersing the treated, coated and cut fibers in a second and more concentrated phenol solution, preferably having a strength on the order of about twenty percent, to soften the exposed cut ends of each of the fibers; (10) juxtaposing said fibers in a predetermined orientation in a high viscosity fluid medium such as vaseline; and (11) subjecting said fibers to heat sufficient to cause said fibers to assume a predetermined curled and interlocked conformation with their opposing cut ends substantially in contact with one another and under slight pressure, whereby said opposing ends which have been softened by exposure to said concentrated phenol solution are bonded to one another to form a permanent structure.

As an alternative to the foregoing process, the fibers could be initially cut to the desired finished length, and coating step (7) and secondary end cutting step (8) could be eliminated. In the latter case, only the ends of the treated fibers rather than the entire surface of the fibers would be exposed to the more concentrated phenol solution prior to the juxtaposing and curling operations. This would produce an interlocked fabric structure similar in configuration to that described in conjunction with the process described earlier herein. However, the latter fabric embodiment differs from the former fabric embodiment in that it is comprised of fibers which do not have a phenol impervious coating on their exterior surfaces.

In still another embodiment of the present invention, an adhesive material may be applied to one or both opposing ends of each of the fibers prior to carrying out the juxtaposing and curling operations. This could be via a conventional adhesive or by application of a small amount of nearly any material having a softening point below the temperature required to produce curling of the fibers. The softened material solidifies and serves to permanently bond the opposing free ends of the fibers to one another when the temperature of the curled fibers returns to ambient. One such material suitable for use with nylon fibers of the type described herein is polyethylene wax.

Figure 2A:
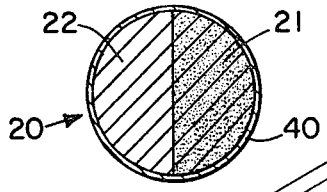
FIG. 2A is a greatly enlarged cross-sectional view taken along section line 2A—2A of FIG. 2.
Figure 2:
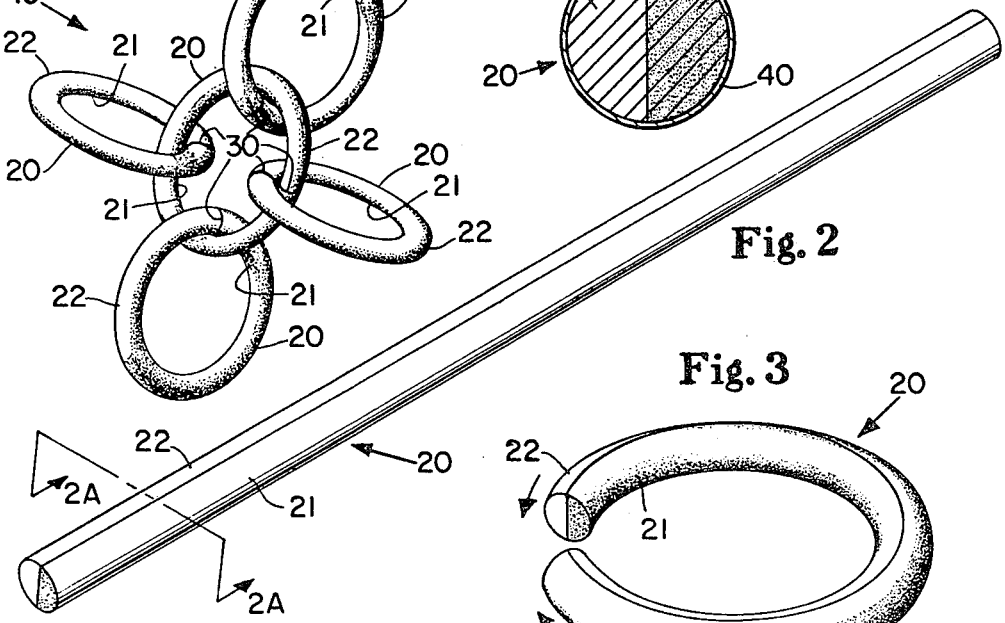
FIG. 2 is a simplified schematic illustration of a single filament of the type utilized to create the structure illustrated in FIG. 1.

As a result of the assymetric phenol treatment described earlier herein, monofilament fibers 20 of the present invention typically exhibit an untreated portion 22, i.e., that portion which floats above the surface of the phenol solution, and a treated portion 21, i.e., that portion which is immersed in the phenol solution. An exemplary treated fiber 20 is illustrated in FIG. 2. Since the fibers are not caused to rotate during the foregoing treatment, the treated portion 21 of the fiber, which corresponds approximately to half of the fiber's cross-section, extends substantially uniformly along the fiber's length.

Figure 3:
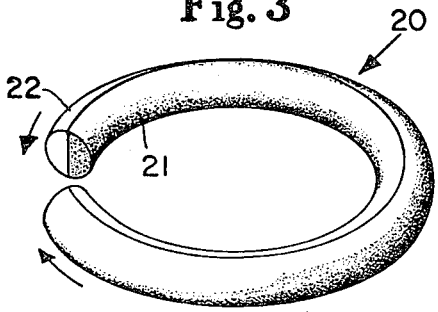
FIG. 3 is an illustration of the filament shown in FIG. 2 as the curling process is being carried out.

It has been demonstrated that substantially straight treated fibers 20 of the present invention may be caused to assume a curled conformation in the direction of the treated portion 21, as generally illustrated in FIG. 3, when placed in vaseline and subjected to an external stimulus, such as a temperature of approximately 200° F. for approximately 15 seconds. While not wishing to be bound by the theory of operation, it is believed that the phenol solution treatment disrupts hydrogen bonds in the drawn and annealed nylon, which is heavily oriented and hydrogen bonded. It is further believed that this disruption of hydrogen bonds only in the areas where said phenol solution is allowed to diffuse causes the molecular chains present in the treated portion 21 of the fiber 20 to revert to a more random coil state. Reversion of the fiber 20 to a coiled state is resisted by the untreated portion 22 of the fiber which remains highly oriented until such time as heat is applied. The heat permits slippage of the molecular chains in the treated portion 21 of the fiber 20, resulting in curling in the direction of the treated portion of the fiber.

Because both the degree and orientation of curl can be determined ahead of time with fibers 20 of the present invention, it is possible to orient the fibers while in a straight configuration such that upon external stimulation, the fibers will be caused to curl and interlock with one another in a predetermined configuration.

While vaseline has been preferred as a fiber retention medium during the fiber juxtaposing and curling operations employed in practicing the present invention, nearly any fluid medium which will not adversely react with the fibers and which exhibits a viscosity high enough to hold the fibers in position at temperatures below the curling temperature, yet low enough that it will not impede curling of the fibers when the curling temperature is reached may be employed with equal facility.

Figure 4:
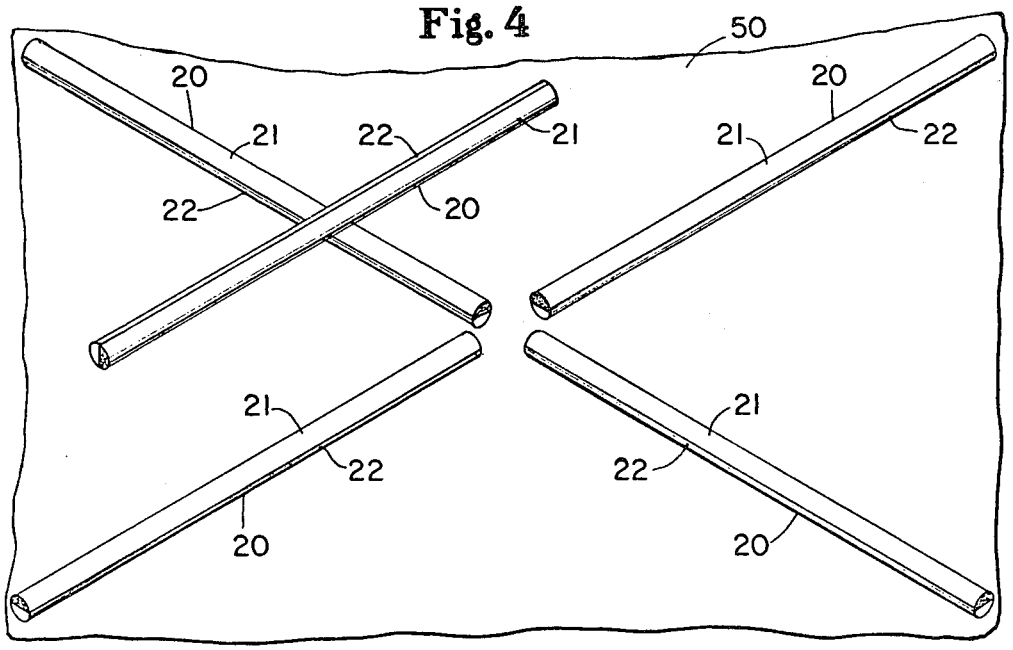
FIG. 4 is a simplified schematic illustration of the manner in which straight filaments of the type shown in FIG. 2 are oriented relative to one another in order to create the interlocking system disclosed in FIG. 1.

One such arrangement for creating an articulated nonwoven fabric 10 of the type generally disclosed in FIG. 1 is illustrated in FIG. 4. In the arrangement illustrated in FIG. 4, four of the treated monofilament fibers 20 are oriented so as to substantially intersect and form a cross with one another. These particular treated fibers 20 are oriented so that their untreated surfaces 22 are embedded in a substrate of vaseline 50. A fifth treated fiber 20 which forms the central loop illustrated in FIG. 1 is positioned so that it is slightly to the left of the intersection of the remaining fibrous elements 20 and is so oriented that the dividing line between its untreated surface 22 and its treated surface 21 is in a plane substantially perpendicular to the plane of the vaseline substrate 50.

Figure 5:
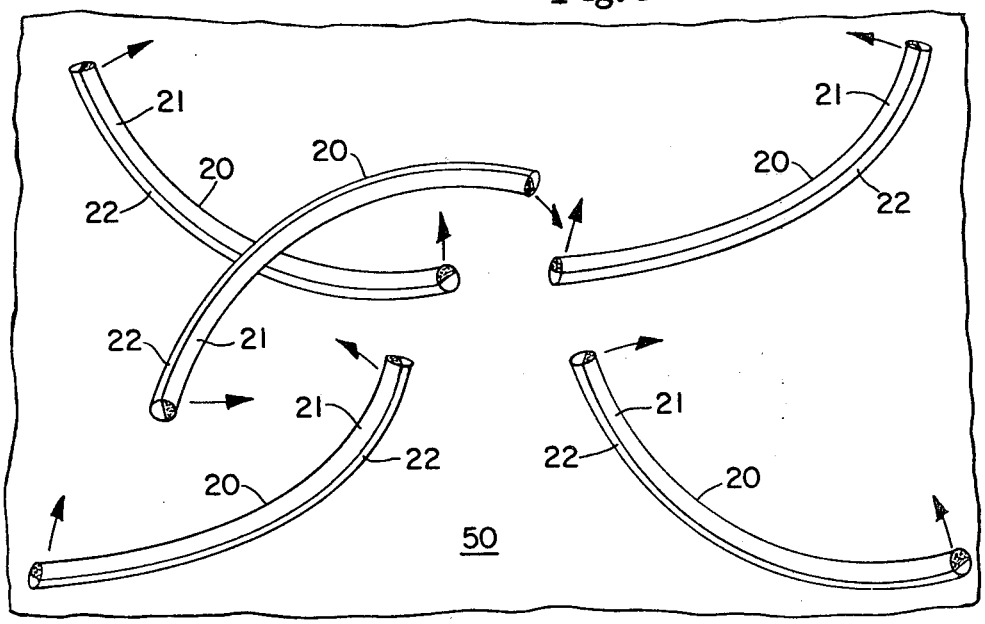
FIG. 5 is an illustration of the filaments shown in FIG. 4 after the self-curling process has been initiated.

When the treated fibers 20 illustrated in FIG. 4 are subjected to external stimulation, in this case a temperature of approximately 200° F., those fibers with their phenol treated surfaces 21 upwardly oriented from the vaseline substrate 50 are caused to curl out of the vaseline in the direction generally indicated by the arrows of FIG. 5. Meanwhile, the fifth or centrally located treated fiber 20 begins to curl in the direction of its treated portion 21 to form a loop in a plane substantially parallel to that of the vaseline substrate 50.

Figure 6:
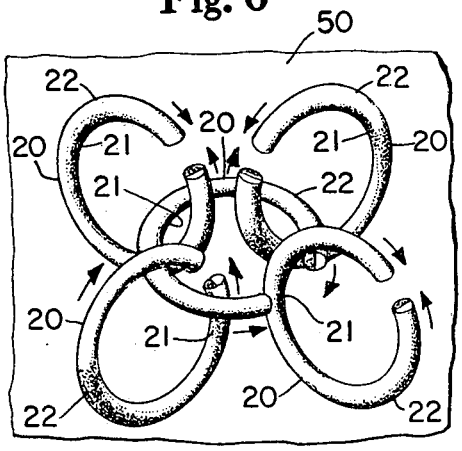
FIG. 6 is an illustration generally similar to that of FIG. 5 showing the filaments just prior to closure of the opposing filament ends with one another.

As the curling process continues, the four treated fiber elements 20 initially having their phenol treated portions 21 upwardly oriented curl out of the plane of the vaseline to form substantially closed rings, as generally shown in FIG. 6. Meanwhile, the fifth treated fiber element 20 having its line of demarcation between the treated portion 21 and the untreated portion 22 of the fiber 20 initially oriented perpendicular to the plane of the vaseline substrate 50 forms an identical circular link which ties the four vertically oriented circular links into interlocking relation with one another.

The heating process is completed when the fiber elements 20 conclude their deformation, i.e., when the opposing free ends of each of the respective elements contact one another.

In the embodiment illustrated in FIGS. 1–6, the exposed cut ends of the fiber elements 20 are unprotected by the phenol-impermeable coating 40 applied to the monofilaments during fiber processing. For purposes of clarity, the phenol-impervious coating 40 which is very thin in relation to the diameter of the fiber 20, is shown only in the cross-sectional view of FIG. 2A. Since the exposed cut ends of the interlocking loops are softened by exposure to a concentrated phenol solution prior to juxtaposing the fibers in the vaseline substrate 50 and initiating the curling process, the softened opposing free ends of each fiber are permanently bonded to one another at joints 30, as generally disclosed in FIG. 1. Because only the exposed cut ends of the fibers 20 are affected by the secondary concentrated phenol treatment, the interlocked continuous rings thus formed remain free to articulate with respect to one another, thus providing outstanding drape and conformability in the resultant nonwoven patterned fabric 10.

While the present invention has been described only in conjunction with a manual process, it is within the scope of the present invention to fully automate the present process, as by continuously treating the monofilament fiber as it is extruded, continuously coating the exterior surfaces of the treated fiber to resist bonding, automatically cutting the coated fiber into discrete predetermined lengths, exposing the cut ends of the fiber to a softening chemical as the fibers are being cut into discrete lengths, automatically applying the coated and treated fibers to one or more sets of vaseline coated combining rolls in a predetermined pattern and in preoriented condition and thereafter subjecting the continuous pattern of preoriented fibers to an elevated temperature sufficient to cause the curling phenomenon to be carried out in the nip between said combining rolls.

It is further recognized that while nylon fibers which have been treated by phenol solution have been disclosed as an exemplary embodiment, other types of fibers could likewise be employed. Furthermore, homogeneous fibers of constant, but irregular cross-section could be extruded to provide an even more pronounced tendency to curl in a predetermined orientation when chemically treated in assymetric fashion, as generally disclosed herein. This would of course necessitate care during the assymetric chemical treatment process to ensure that the fiber's tendency to curl upon external stimulation is enhanced rather than negated. In still other embodiments, bicomponent fibers having dissimilar coefficients of expansion and contraction might also be employed in conjunction with the assymetric chemical treatment to provide fibers exhibiting a highly pronounced tendency to curl in a predetermined orientation upon external stimulation.

While particular, embodiments of the present invention have been illustrated and described, it will be obvious to those skilled in the art that various changes and modifications can be made without departing from the spirit and scope of the invention. It is intended to cover in the appended claims all such modifications that are within the scope of this invention.

What is claimed is:

1. A method for producing a patterned, nonwoven, articulated fabric exhibiting a substantially uniform texture and comprised of a multiplicity of synthetic fiber elements, the opposing free ends of each of said synthetic fiber elements being joined to one another to form substantially continuous loops, said loops being interconnected to one another in a predetermined pattern, said method comprising the steps of:

(a) preparing a multiplicity of substantially straight synthetic fiber elements of predetermined length, each of said elements exhibiting a non-uniform shrinkage potential along its cross-section, as measured in a direction substantially perpendicular to its length;

(b) orienting said substantially straight synthetic fiber elements so that said non-uniform shrinkage potential along their cross-sections will cause them to simultaneously curl in a predetermined orientation and interlock with one another when said fibers are subjected to a predetermined external stimulus;

(c) subjecting said synthetic fiber elements to said predetermined external stimulus, thereby causing said fibers to curl in a predetermined orientation and interlock with one another; and (d) joining the opposing free ends of each of said fiber elements to one another to form substantially continuous loops which are interconnected with one another in a predetermined pattern.

2. The method of claim 1, wherein said opposing free ends of each of said fiber elements are joined to one another by subjecting the opposing free ends of each of said fiber elements to a softening treatment which acts only on said opposing free ends of said fiber elements and thereafter contacting said softened ends with one another under slight pressure while said elements are in a curled conformation.

3. A method for producing a patterned, nonwoven, articulated fabric exhibiting a substantially uniform texture and comprised of a multiplicity of synthetic fiber elements, the opposing free ends of each of said synthetic fiber elements being joined to one another to form substantially continuous loops, said loops being interconnected to one another in a predetermined pattern, said method comprising the steps of:

(a) preparing a multiplicity of substantially straight synthetic fiber elements of predetermined length, each of said elements exhibiting a non-uniform shrinkage potential along its cross-section, as measured in a direction substantially perpendicular to its length;

(b) orienting said substantially straight synthetic fiber elements so that said non-uniform shrinkage potential along their cross-sections will cause them to simultaneously curl in a predetermined orientation and interlock with one another when said fibers are subjected to heat;

(c) subjecting said synthetic fiber elements to heat, thereby causing said fibers to curl in a predetermined orientation and interlock with one another; and (d) joining the opposing free ends of each of said fiber elements to one another to form substantially continuous loops which are interconnected with one another in a predetermined pattern.

4. The method of claim 3, wherein said snythetic fiber elements are comprised of nylon and said preparation comprises treating said fiber elements with phenol approximately half way through their cross-section.

5. The method of claim 3, wherein said opposing free ends of each of said fiber elements are joined to one another by subjecting the opposing ends of each of said fiber elements to a softening treatment and thereafter contacting said softened ends with one another under slight pressure while said elements are in a curled conformation.

6. The method of claim 5, wherein said fiber elements are comprised of nylon and said softening treatment comprises exposing the opposing free ends of said fibers to phenol.

7. The method of claim 3, wherein said opposing free ends of each of said fiber elements are joined to one another by applying an adhesive material to at least one of said opposing free ends prior to causing said fibers to curl in a predetermined orientation.

8. The method of claim 7, wherein said fiber elements are comprised of nylon and said adhesive is comprised of polyethylene wax.

9. The method of claim 3, wherein said fiber elements are oriented by placing them in a fluid medium having a viscosity which is high enough to substantially prevent movement of said fiber elements at temperatures below the curling temperature.

10. The method of claim 9, wherein said fluid medium has a viscosity low enough that it will not impede curling of said fiber elements when the curling temperature is reached.

11. The method of claim 9, wherein said fluid medium comprises vaseline.

* * * * *